United States Patent [19]

Densen

[11] Patent Number: 4,512,477

[45] Date of Patent: Apr. 23, 1985

[54] READILY ERECTABLE WARDROBE CABINET AND A MODE OF PACKAGING THE SAME

[76] Inventor: Mark S. Densen, 18 Blackburn Place, Summit, N.J. 07901

[21] Appl. No.: 483,300

[22] Filed: Apr. 8, 1983

[51] Int. Cl.[3] ..... B65D 85/18

[52] U.S. Cl. ..... 206/577; 220/4 F; 229/44 R; 206/292; 206/298

[58] Field of Search ..... 220/4 F; 206/299, 280, 206/292, 600, 223, 577, 298; 229/44 R

[56] References Cited

U.S. PATENT DOCUMENTS

| | | | |
|---|---|---|---|
| 2,815,119 | 12/1957 | Field et al. | 206/280 |
| 2,989,226 | 6/1961 | Swartz | 220/4 F |
| 3,189,173 | 6/1965 | Kulka | 206/389 |
| 3,262,631 | 7/1966 | Belsinger | 206/299 |
| 3,357,542 | 12/1967 | Aquino et al. | 206/299 |
| 3,493,101 | 2/1970 | Collin | 206/280 |
| 3,887,068 | 6/1975 | Ghione | 206/223 |
| 3,893,566 | 7/1975 | Ross | 229/44 R |

FOREIGN PATENT DOCUMENTS

| | | | |
|---|---|---|---|
| 2490186 | 3/1982 | Fed. Rep. of Germany | 206/600 |

*Primary Examiner*—Joseph Man-Fu Moy
*Attorney, Agent, or Firm*—Arthur T. Fattibene

[57] ABSTRACT

A readily erectable wardrobe type cabinet formed of several blanks of readily foldable sheet material which are die cut and scored with constructional and non-constructional foldlines. A pair of such blanks define a half back panel portion and side panel, which are connected to define a body portion. Another blank defines a front panel having a hinged front closure portion, and another blank defines a bottom panel. Still another blank defines a top panel having a hinged portion to provide a top access to the assembled wardrobe. The respective blanks are each provided with scored foldlines about which the respective blanks are folded to form the constructed or erected component part. Each blank is also formed with scored non-constructive foldlines about which each blank is folded in its own knock-down position to define folded blanks of generally uniform width which can then be readily stacked one on the other in their respective knock-down position, and the blanks so stacked being enclosed or encased in a protective shrink wrap plastic sheet to define a rectangularly shaped package which can be readily stored, shipped and/or displayed in a minimum of space.

6 Claims, 17 Drawing Figures

FIG. 3
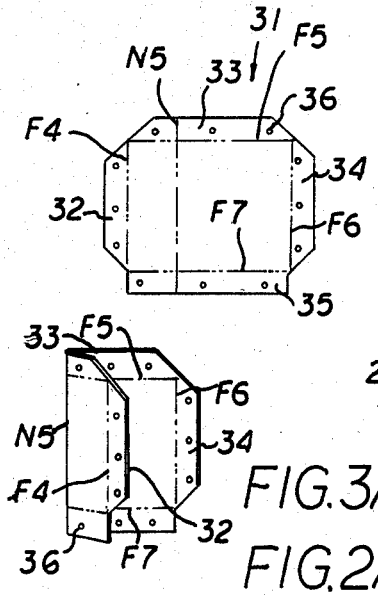
FIG. 3A
FIG. 2
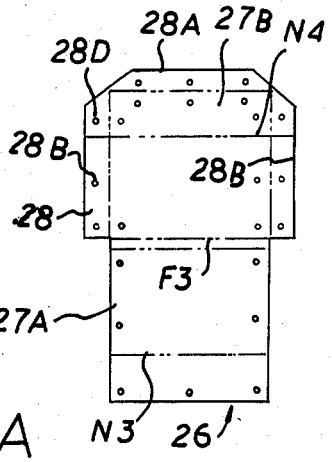
FIG. 1
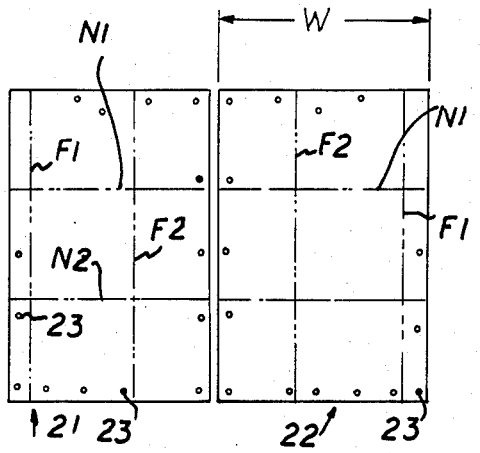
FIG. 2A
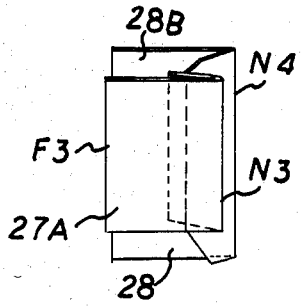
FIG. 1A
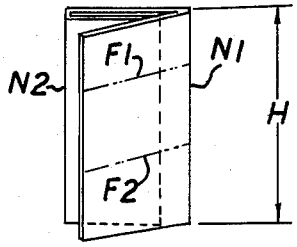
FIG. 4
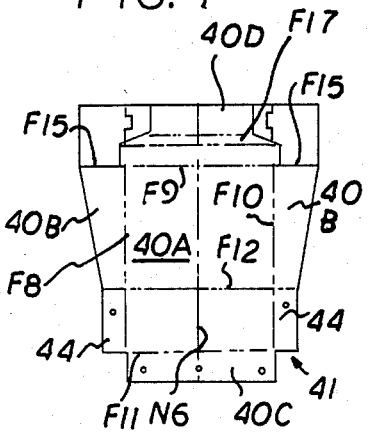
FIG. 4A
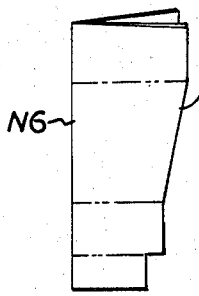
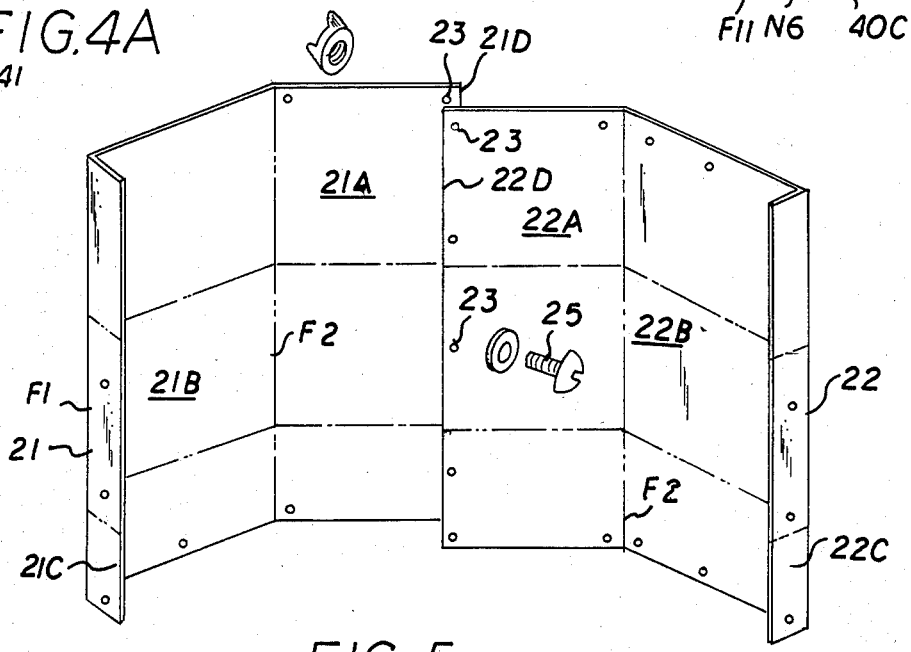
FIG. 5

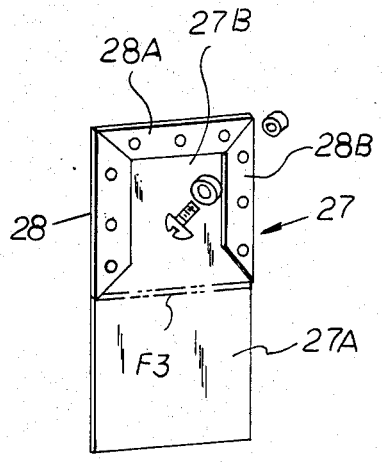
FIG. 6
FIG. 7
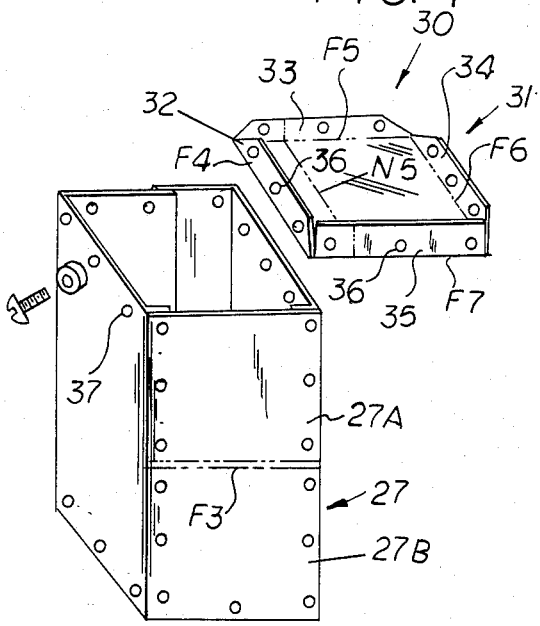
FIG. 8
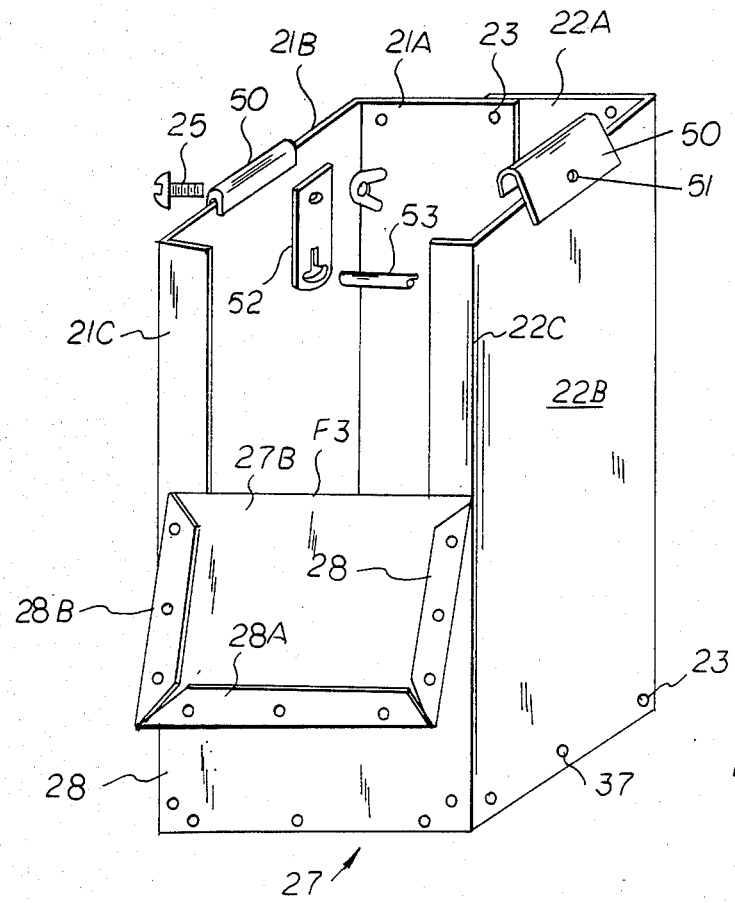
FIG. 9

READILY ERECTABLE WARDROBE CABINET AND A MODE OF PACKAGING THE SAME

PROBLEM AND PRIOR ART

Heretofore, various efforts have been made to provide storage type boxes and/or cabinets of readily foldable blanks of sheet material such as cardboard, corrugated board and the like. One of the problems encountered with such storage boxes and/or cabinets resided in the manner in which such blanks are preformed so as to simplify the erection and/or assembly thereof; and at the same time enable the assembled unit to be durable and sturdy in construction. For relatively large units of such construction, e.g. wardrobes, closet type cabinets or the like, a more serious problem has been noted, and that is the problem of space in storing, shipping and/or displaying such large units. Because such knock-down wardrobes and/or large storage cabinets are required to be made relatively large sheets of blank material, often comprising several panels of irregular shape and sizes, extreme problems have been encountered in the storage, shipping and/or display of such units, either in their assembled and/or knock-down arrangement. Because of such noted problems and difficulties, the manufacturing and the merchandising of relatively large units formed of foldable blanks of sheet material has been somewhat limited thereby.

OBJECTS

An object of this invention is to provide for an improved construction and arrangement of packaging relatively large preformed blanks of sheet material which in their erected position define a relatively large storage unit such as wardrobes and/or storage closets, cabinets or the like.

Another object is to provide for an improved wardrobe or storage cabinet unit formed of preformed blanks of sheet material which in the erected position defines a sturdy and durable unit.

Another object is to provide a relatively large storage unit such as a wardrobe formed of preformed blanks of sheet material which are provided with non-constructional foldlines to facilitate the compacting of such preformed blanks in their knock-down position to form a package of an optimum size which can be readily handled, stored, shipped or displayed with a minimum of care.

Another object is to provide an improved wardrobe or cabinet construction arranged so as to provide ease of access thereinto.

SUMMARY OF THE INVENTION

The foregoing objects and other features of the invention are attained by a storage unit, such as a wardrobe or storage closet which is formed of readily foldable blanks of sheet material formed of cardboard, corrugated board and the like. The respective back, sides, top and bottom are each formed of preformed cut and scored blanks which can be readily folded to form the erected unit and/or folded to be compactly packed in the knock-down position thereof to form a package that can be handled, stored, shipped or displayed with relative ease. This is attained by providing each blank with score lines by which the blanks can be readily folded to erect and maintain the component parts in the erected position of the cabinet. The respective blanks also include one or more non-constructional score or foldlines about which the respective component preformed blanks may be folded in their respective knock-down position to permit them to be formed in a compact package with a shink wrap type of film or enclosure which permits the package of preformed blanks to be readily handled, shipped or displayed.

The respective preformed blanks are also die cut and scored in a novel manner whereby the respective blanks can be erected and assembled with a maximum or ease and without the need of tools by an ultimate user or consumer. This is attained by forming the back and adjacent sides of a relatively large wardrobe type cabinet from a pair of substantially identically formed preformed blanks, and having a front panel having a foldable upper portion arranged to swing between an open and closed position. The top panel of the cabinet is formed as a hinged cover from a single blank and which in the assembled position functions to co-act with the hinged front to provide an access to the interior of the wardrobe from both the top and front so as to facilitate the placement and/or removal of the garments or articles stored therein.

FEATURES

A feature of this invention resides in the provision of a relatively large wardrobe type cabinet which is formed of preformed blanks of foldable material which can be readily erected and which provide a novel arrangement of a hinged top and a hinged front panel to define access to the erected cabinet from both the top and front.

Another feature resides in a relatively large wardrobe type cabinet formed of preformed blanks of foldable material wherein each blank is readily folded in its knock-down form so as to be of generally uniform width whereby the respective blanks can be readily stacked and wrapped to define a manageable package in its knock-down state.

Another feature resides in a relatively large knock-down type cabinet which is sturdy in the erected form and which can be in its knock-down position readily packaged for shipment and/or display.

Other features and advantages will become more readily apparent when considered in view of the drawings and specifications in which:

FIG. 1 is a plan view of a pair of similarly formed blanks which in the assembled position define the body portion of the storage cabinet.

FIG. 1A is a perspective view of blanks of FIG. 1 folded for packaging.

FIG. 2 is a plan view of the blank defining the front panel of the cabinet.

FIG. 2A is a perspective view of the blank of FIG. 2 folded for packaging.

FIG. 3 is a plan view of the blank defining the bottom panel.

FIG. 3A is a perspective view of the blank of FIG. 3 folded for packaging.

FIG. 4 is a plan view of the preformed blank defining the hinged top panel.

FIG. 4A is a perspective view of the blank of FIG. 4 folded for packaging.

FIG. 5 is a partially erected view of the panels defining the cabinet body.

FIG. 6 is a partially erected view of the front panel.

FIG. 7 is an erected view of the bottom panel.

FIG. 8 is an erected view of the body of the cabinet with the front panel attached illustrated in an inverted position.

FIG. 9 is a partially erected view of the storage cabinet illustrating the relationship of the hanger for the hanger rod.

DETAILED SPECIFICATION

Figure 10:
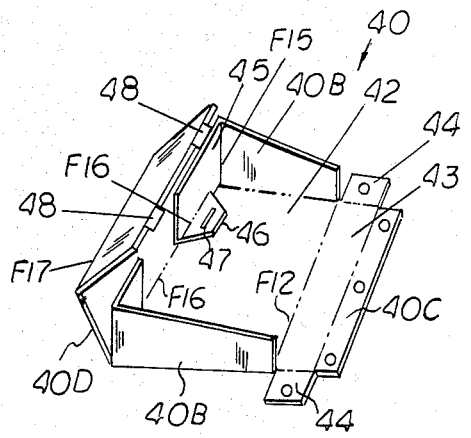
FIG. 10 is a perspective view illustrating the erection of the top panel.

Referring to the drawings, there is shown therein a readily knock-down storage cabinet 20 formed of readily foldable blanks of sheet material. The illustrated embodiment of the invention is primarily directed to relatively large size storage type cabinets, such as wardrobes, closets and the like in which garments and such may be hung. Such cabinets or wardrobes 20 in their erected or assembled position are relatively large structures that may stand four, five or more feet high and have a circumference of approximately twelve or more feet. In order to enable such knock-down type of cabinet or wardrobe 20 to be erected of foldable sheet material, which is both sturdy and durable in construction, the respective component parts of blanks, as will be hereinafter described, are specifically preformed, die cut and scored so that each blank can be readily erected and assembled to form the unit or cabinet 20. The respective blanks are further provided with non-constructional scores or foldlines to fold the respective blanks to a manageable package size that can be readily handled, stored or displayed.

Referring to FIG. 1, there is shown a pair of preformed blanks 21 and 22 formed of sheet material, such as cardboard, corrugated board or the like, each of which is scored to define foldlines $F_1$ and $F_2$ about which each blank 21 or 22 can be readily folded to erect the cabinet or wardrobe 20. The respective blanks 21 and 22 are also provided with non-constructional foldlines $N_1$ and $N_2$ extending transversely of the respective blanks 21 and 22 about which the respective blanks can be folded as best seen in FIG. 1A, for purposes of reducing the overall size of the blanks 21 or 22 for ease of packaging and handling. The respective blanks 21 and 22 are likewise formed with a plurality of holes 23 spaced about the marginal edge portions which are arranged to complement holes formed in the other component panels, as will be hereinafter described so that the respective components can be readily secured by suitable fasteners such as nuts and bolts.

As best seen in FIG. 5, each blank 21 and 22, when folded about foldlines $F_1$ and $F_2$ to erect the cabinet defines a half back panel 21A, 22A and a connected side panel 21B, 22B. The marginal portion 21C and 22C, when folded about foldline $F_1$ to a position normal to the adjacent side panel 21B or 22B, defines a front flange 21C or 22C. The free edge 21D and 22D of the respective blanks 21 and 22 in the erected position are disposed in overlapping position, so that the openings 23 of the respective blanks are disposed in alignment to receive the fasteners 25 by which the two blanks 21 and 22 are secured to define the body portion of the cabinet or unit 20.

FIG. 2 and $F_{2A}$ illustrates the blank 26 from which the front panel 27 is formed. Blank 26 is provided with a pair of non-constructional foldlines $N_3$ and $N_4$ about which the blank can be folded in its knock-down position as seen in FIG. 2A. Intermediate the length of blank 26 is a constructional foldline $F_3$ to define the front panel into a lower portion 27A which is fixed to the front flange 21C and 22C of the body portion of the cabinet 20, and an upper portion 27B which is hingedly connected about foldline $F_3$. The upper portion 27B of the front panel is provided with circumscribing marginal portions 28, 28A and 28B, which are adapted to be reversely folded onto the plane of the upper portion 27B as best seen in FIG. 6 to define the completed front panel 27. As seen in FIG. 2, the marginal portion 28, 28A and 28B are provided with spaced holes 28D which are adapted to coincide with holes 28E spaced about the marginal portion of the upper portion 27B of the front panel. In the folded position, the marginal flaps or portions 28, 28A and 28B are secured to the plane of the upper front portion 27B by fastener 25. With the front panel 27 secured to the body portion of the cabinet as seen in FIG. 9, the upper front portion 27B is free to pivot between an open and closed position.

FIG. 3 illustrates the blank 30 from which the bottom panel 31 is formed. The bottom blank 30 is preformed of sheet material to define the bottom panel 31 having hingedly connected a plurality of circumscribing flaps 32, 33, 34 and 35, which are folded about scored foldlines $F_4$, $F_5$, $F_6$ and $F_7$. As seen in FIG. 7, the respective flaps 32, 33, 34 and 35 are folded normal to the bottom panel. Each of the flaps 32, 33, 34 and 35 are provided with holes 36 which are arranged to coincide with complementary holes 37 formed along the base portion of the cabinet. To assemble the bottom panel 31 to the cabinet body, the body is inverted as seen in FIG. 6, and the bottom 31 is then fitted so that the flaps 32, 33, 34 and 35 are contiguous to the side, front and back panels which define the body of the cabinet 20. Fasteners such as bolts 25 secure the bottom panel 27 to the bottom of the body portion.

The blank 30 defining the bottom panel 31 is also provided with a non-construction foldline $N_5$, about which the blank 30 can be folded in the knock-down position as best seen in FIG. 3A.

It will be understood that the non-constructional foldlines are formed so that the respective blanks can be folded thereabout in the knock-down position only so that each blank can be sized so that they can be readily stacked to form a manageable package, as will be hereinafter described.

Figure 11:
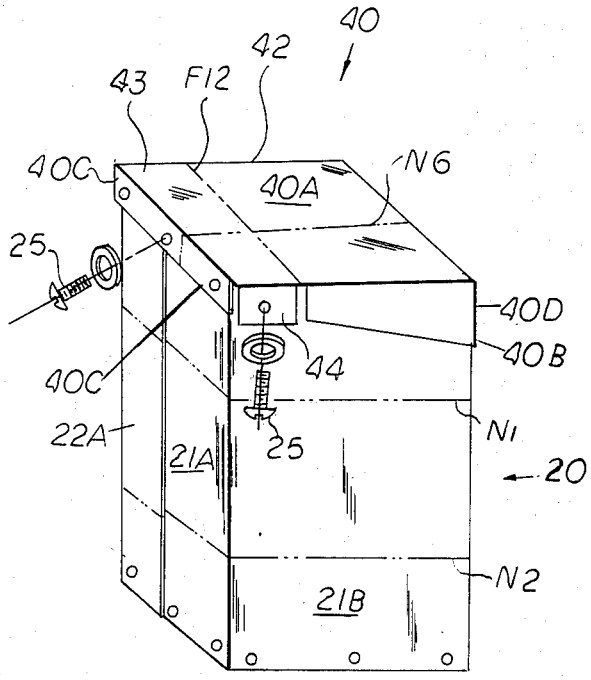
FIG. 11 is a perspective view illustrating the assembly of the top panel to the body portion.
Figure 12:
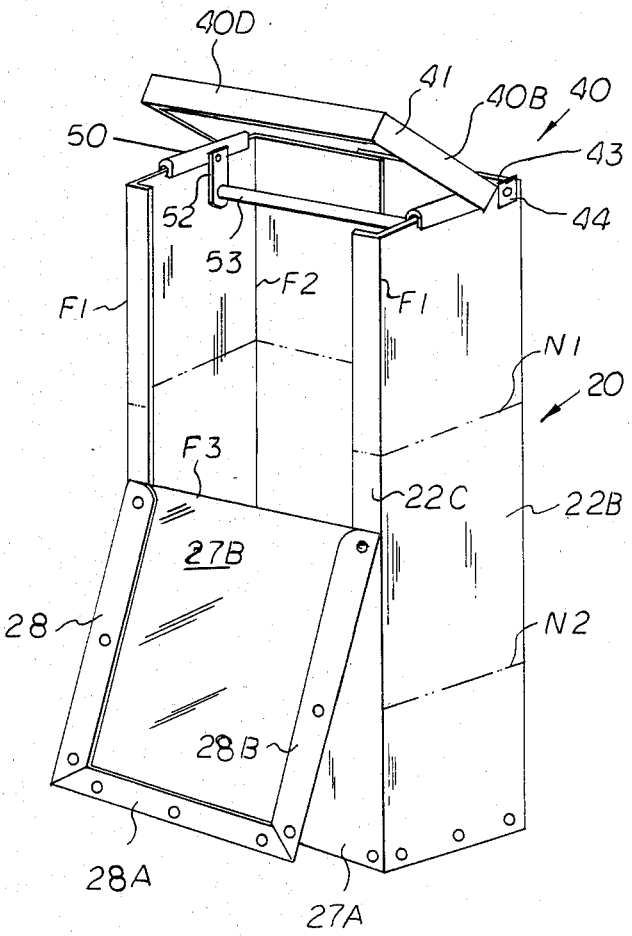
FIG. 12 is a perspective view of the assembled storage cabinet illustrating the access opening to the cabinet.

The top panel 40 is formed of a single blank of sheet material 41 as best seen in FIG. 4. The blank 41 is die cut and scored so that the top panel 40 can be readily formed. As best seen in FIG. 4 and FIG. 10, the blank 41 is provided with rectangularly disposed foldlines $F_8$, $F_9$, $F_{10}$ and $F_{11}$ to define the top panel portion 40A. Extending transversely of the top panel portion in a foldline $F_{12}$ to define a hingedly connected top portion 42 and a mounting portion 43. See FIGS. 11 and 12. Hingedly connected about foldlines $F_8$, $F_9$, $F_{10}$ and $F_{11}$ are opposed top side flaps 40B, 40B, a top rear flap 40C, and a top front flap 40D. It will be noted that the top side flaps 40B, 40B are co-extensive to the hinged top portion 42. The mounting portion 43 is provided with side flap extensions 44, 44 which in the assembled position, as shown in FIGS. 11 and 12, are secured to the upper side panels 21B and 22B respectively by suitable bolt and wing nut type fasteners 25.

Connected to the respective top side flaps 40B, 40B are side flap extensions 45 which are foldable normal to the side flaps 40B in the assembled position about a foldline $F_{15}$. Connected to the flap extension 45 and foldable normal thereto about foldline $F_{16}$ is an ear 46 having a slot 47 formed in the plane thereof. In the assembly of the top panel as shown in FIG. 10, the ear 46 is disposed in underlying relationship to the hinged portion 42. The front side flap 40D is provided with a transversely extended foldline $F_{17}$ about which the front flap 40D is reversely folded about the top side flap extension 45 as best noted in FIG. 10. The free edge of the top front flap is provided with a tab 48 which is received in the slot 46 to maintain the top front flap 40D in the folded position. With the blank 41 folded as described to define the top panel 41, it will be noted that the top panel can be readily assembled to the top of the body portion of the cabinet by aligning the holes formed in the top rear panel 40C and side extension 44 with corresponding holes spaced along the upper back panel and adjacent side panel of the body portion and securing with a fastener 25.

In accordance with this invention, the blank 41 defining the top forming panel 40 is provided with a non-constructional foldline $N_6$ about which blank 41 can be folded in the knock-down position as best seen in FIG. 4A.

Figure 13:
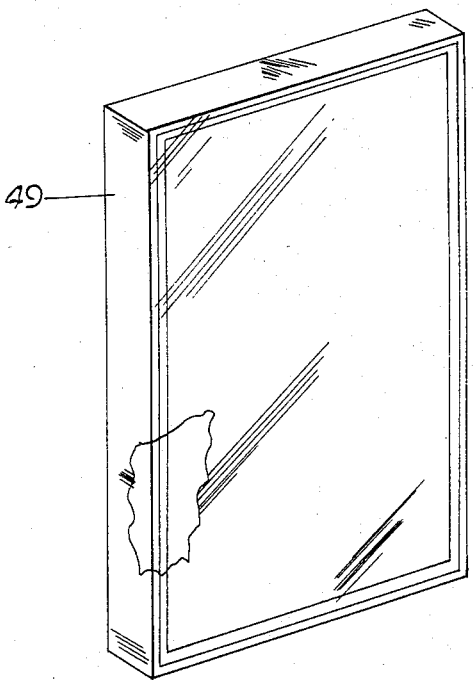
FIG. 13 is a perspective view of the component blanks packaged for shipment and/or storage.

By providing each of the blanks 21, 22, 26, 31 and 41 with the non-constructional foldlines $N_1$–$N_6$ as described, each of the respective blanks can be folded in their respective knock-down position whereby the height H of any of the folded blanks will not exceed the width W of the body forming blanks 21 or 22. Accordingly, the respective folded blanks in their knock-down position can be readily stacked one on the other to define a relatively compact package as best seen in FIG. 13, and the respective blanks so stacked being encased in a shrink-wrap type covering 49, or box (not shown). Thus, the package including the relatively large blanks 21, 22, 26, 31 and 41 required to form the cabinet or wardrobe can be reduced to an optimum size to facilitate handling, shipping, storing and/or displaying. Also, the non-constructional foldlines $N_1$–$N_6$ are so formed that they will not interfere with or hamper the folding and/or assembly of the respective component parts as herein described.

In order to provide a means for hanging garments in the cabinet or wardrobe 20, a hanging means is provided. As best seen in FIG. 9, the hanging means includes a pair of reversely bent rod supports 50 which are formed to embrace the top edge of the respective side panels 22B. A hole 51 is formed in a depending leg portion of the rod support 50 by which it may be secured to the side panel by a fastener 25. As shown, the rod support 50 is generally of an inverted J section. A hanger strap 52 is secured to the inner surface of the respective side panels 21B, 22B of the cabinet by the fastener 25; and a hanger rod 53 is supported between the respective straps 52. It will be understood that the hanger means is assembled to the body portion of the cabinet or wardrobe before the top panel 40 is connected to the body portion.

As best seen in FIG. 12, the component parts in their fully assembled position define a wardrobe or cabinet of a relatively large size in which access is provided both from the front and the top. In the closed position, the upper portion 27B of the front panel is maintained in its closed position by the hinged portion 42 of the top panel as the front flap 40D of the top panel overlies the upper edge of the front panel 27 in the closed position. See FIG. 11. To gain access to the cabinet 20, the user merely opens the top panel which then frees the upper portion of the front panel to swing to an open position as shown in FIG. 12. Thus, a full and unrestricted access is had to the interior of the assembled cabinet 20. Also, the arrangement is such that the cabinet or wardrobe 20 can be maintained in a closed or sealed position without any other holding means other than the use of the top panel; as herein described.

For the foregoing, it will be apparent that a relatively large readily knock-down cabinet formed of readily foldable blanks of sheet material can be readily erected without the use of any hand tools in the assembled position, and which in the knock-down position can be readily formed into a relatively small, flat package which can be easily shipped, stored or displayed in a minimum of space. Also, the non-constructional foldlines, as described, are arranged so that they do not interfere with the construction and/or strength of the assembled wardrobe or cabinet. The specific construction and co-action of the front and top panels are such that full access is provided with the cabinet from both the top and front, and whereby a positive closure arrangement can be had without reorting to the use of any latching-type closure means.

While the invention has been described with respect to a particular embodiment thereof, it will be appreciated and understood that variations and modifications may be made without departing from the spirit or scope of the invention.

What is claimed is:

1. A knock-down wardrobe cabinet comprising a pair of substantially identical blanks of sheet material having transversely extending foldlines to define in the folded position a half back panel, an adjacent side panel, and a front connected flange, a blank formed of readily foldable material to define a bottom panel having hingedly connected thereto circumscribing side, front and back flanges disposed normal to said bottom panel, a blank of readily foldable material to define a front panel adapted to be connected to said front flanges, said front panel having a transversely extending foldline intermediate the top and bottom thereof about which said front panel can be folded between an open and closed position, and a blank of foldable sheet material defining a top panel, said top panel having a transversely extending foldline about which said top panel is hingedly folded between an open and closed position, and said top panel having a depending front flange connected thereto whereby said top panel front flange in the closed position of said top panel overlie the upper edge of the front panel in the closed position thereof to effect the closure of said wardrobe, and including a hanger rod, and support means for detachably supporting said hanger rod between the side panels, said support means including a reversely bent rod support fitted on the upper edge of said respective side panel, a hanger strap, and means for connecting said rod support and hanger strap to the respective corresponding side panel, and said hanger rod being supported on and between said hanger straps.

2. A knock-down wardrobe cabinet as defined in claim 1, wherein said top panel is formed of a single sheet of foldable material having a plurality of transversely extending, foldlines to define a top mounting portion and a hingedly connected folding top portion, said top mounting portion having a hingedly connected back flap and opposed side flaps adapted to be connected to the back and side panels respectively, and a reversely folded front flange dependingly connected to said folding top portion, and opposed side flaps hingedly connected to said folding top portion, a front flap hingedly connected to each of said side flaps adapted to be folded normal to its corresponding side flaps in the folded position, and said reversely folded front flange being reversely folded about said front flaps, and means for securing said reversely folded front flange in the folded position thereof.

3. A knock-down wardrobe cabinet as defined in claim 2 wherein said last mentioned securing means comprises an ear flap hingedly connected to said front flap to underlie said top portion, said ear flap having a notch out opening formed therein, and said front flange having a projecting tab adapted to be received in said notched out opening in the folded position thereof.

4. A knock-down wardrobe cabinet as defined in claim 1 wherein each of said blanks include a non-construction foldline extending transversely of each of said blanks so that each of said blanks when folded about its respective non-construction foldline in the collapse position define a folded blank of generally uniform width and a height not greater than the length of the non-construction foldline of said pair of blanks.

5. A knock-down wardrobe cabinet as defined in claim 1 wherein in the knock-down position the respective blanks folded about their respective non-constructional foldlines are disposed in overlying stacked relation, and a shrink wrap cover encasing said stacked blanks.

6. A readily erectable wardrobe cabinet comprising a pair of identically formed blanks of foldable sheet material, each of said blanks including a half back panel and a connected side panel, each of said back panels in the assembled position having overlapping marginal edge portions, and fastening means for securing said overlap portions in the assembled position so as to define a U-shaped body, a bottom panel connected to said side and back panel, a front panel connected to said body, said front panel having a lower portion and an upper front portion hingedly connected to said lower front portion along a transversely extending fold, means connecting said lower front portion to said body whereby the upper front portion is free to hinge between an open and closed position along said fold, and a top panel connected to said body to define a top closure therefor, said top panel having a hinged top portion for swinging between open and closed positions, said top portion having a depending front flange for retaining the upper portion of said front panel in the closed position so that the swing of said hinged top portion to open position effectively permits the upper front portion to swing to open position and allowing access to the wardrobe from both the top and front, and each of said blanks defining said back, sides, top, bottom and front panels are provided with a non-constructional transversely extending foldline whereby each of said respective blanks in their knockdown position can be folded so that each is formed with a uniform width and having a height not exceeding the transverse width of the blank defining said half back and connected side panel.

* * * * *